United States Patent [19]

Gray

[11] Patent Number: 5,010,647

[45] Date of Patent: Apr. 30, 1991

[54] IMPACT SCRAPING TOOL FOR SCRAPING MATERIAL FROM SURFACES

[76] Inventor: Thomas C. Gray, 683 N. Fox, Flagstaff, Ariz. 86001

[21] Appl. No.: 385,284

[22] Filed: Jul. 25, 1989

[51] Int. Cl.[5] ..... B26B 3/00

[52] U.S. Cl. ..... 30/169; 173/90; 15/236.01

[58] Field of Search ..... 173/90, 128; 15/236.01; 30/169, 172

[56] References Cited

U.S. PATENT DOCUMENTS

| | | | |
|---|---|---|---|
| 1,710,113 | 4/1929 | Rothermel | 15/236.01 X |
| 2,105,960 | 1/1938 | Wolfe | 15/236.01 X |
| 2,359,408 | 10/1944 | Disse | 15/236.01 X |
| 4,381,604 | 5/1983 | Horst | 15/236.01 X |
| 4,624,323 | 11/1986 | Burrola | 173/90 |
| 4,779,301 | 10/1988 | Millette | 15/236.01 |

*Primary Examiner*—Paul A. Bell

*Assistant Examiner*—Willmon Fridie, Jr.

*Attorney, Agent, or Firm*—Frederick Gotha

[57] ABSTRACT

An improved impact scraping tool for scraping material from surfaces is set forth having a ramming member for transmitting externally applied thrust forces to a thrust member which is slidably mounted to the ramming member for relative motion therewith. The ramming member has a discontinuity in cross-section which when engaged by the thrust member stops the relative motion between the members and results in a transfer of the momentum of the ramming member to the thrust member. A blade support plate having lateral grooves in its upper and under surfaces is carried by the thrust member and clamped to a pair of T-shaped claims which have laterally extending shoulders for engagement into the grooves. Material scraped from surfaces is precluded from wedging between the clamps and the blade support plate which prolongs the life of the scraping tool.

8 Claims, 1 Drawing Sheet

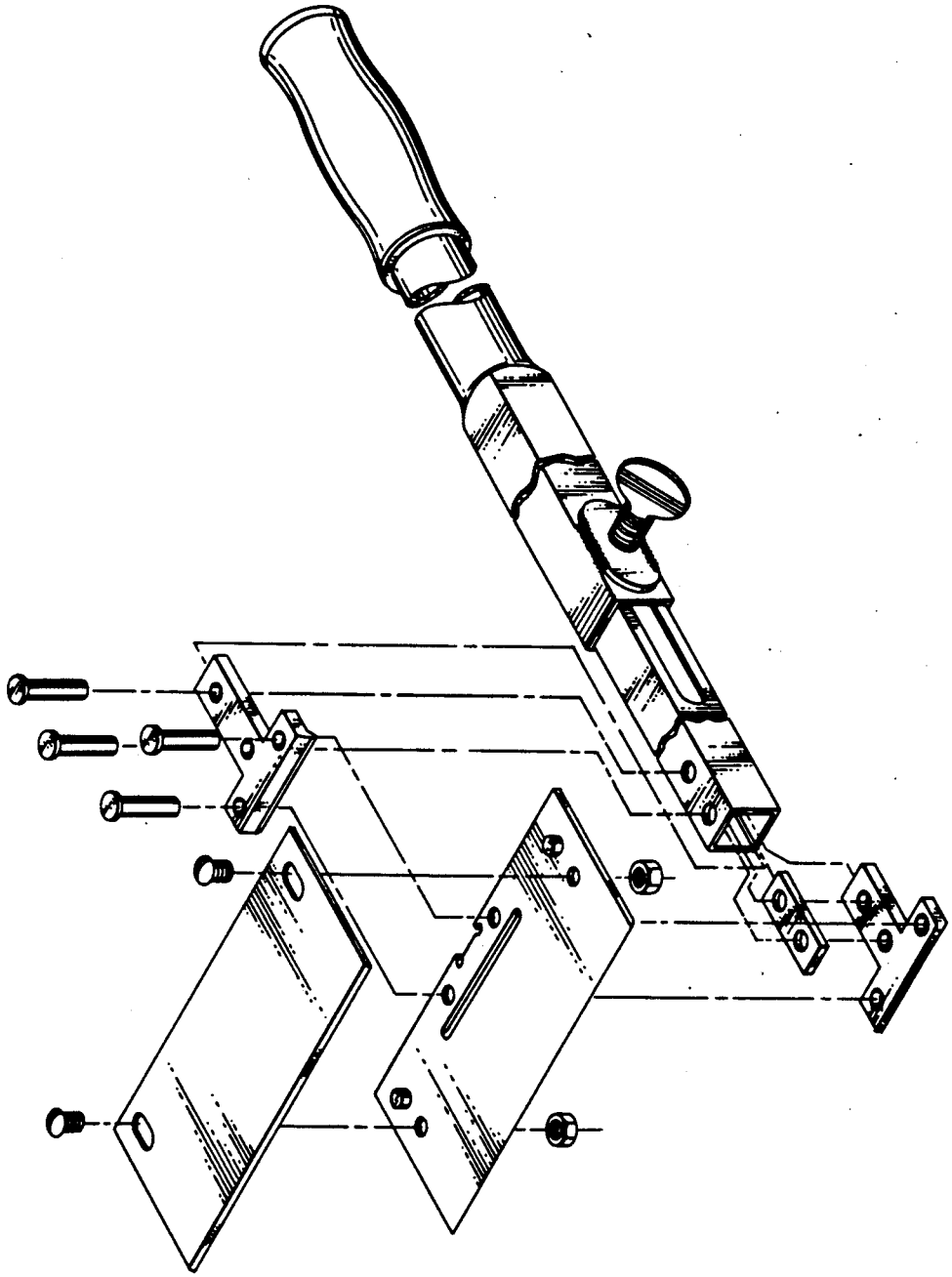

IMPACT SCRAPING TOOL FOR SCRAPING MATERIAL FROM SURFACES

FIELD OF THE INVENTION

This invention relates to an impact scraping tool for scraping various types of material from a surface.

BACKGROUND OF THE INVENTION

To facilitate the removal of materials such as linoleum, ceramic tile, rugs and other adhesive plastics from a surface such as a floor, it is desirable to remove flooring material without using a power tool or requiring an individual to labor on hand and knee with a hammer and chisel or an ice scraper to remove the surface material. Removing material from surfaces in such a manner is extremely difficult and time consuming. Additionally, in some instances, particularly with old structures, the presence of asbestos flooring presents a health hazard when, in the process of removing the flooring, asbestos fibers are released into the environment. Consequently, in the removal of flooring known to contain asbestos, it is desirable to keep the dust particles to a minimum while also keeping the individuals removing the asbestos material as far as practicable from the source of dust.

Conventional scrapers require that the individual pull back the entire tool before thrusting the tool in order to achieve sufficient impact against the floor material to dislodge it. Consequently, conventional scrapers generate more dust in their operation and require much more effort in redirecting the cutting blade to exactly the same place during the tool stroke.

Conventional scraping tools are easily contaminated because their surfaces trap dust and other particles between the scraping blade clamps and the scraping blade. The build up of dust and particle debris between the blade clamp and the cutting blade ultimately causes a separation to occur between the clamp and blade due to the wedging action of the dust and particles. This action eventually leads to a failure in the fastener members holding the clamp and blade together and in some instances structural failure of the clamp.

SUMMARY OF THE INVENTION

There is, therefore, provided according to the present invention, an improved impact scraping tool for scraping material from surfaces which can be economically mass produced, which during operation limits the release of dust into the environment by maintaining the scraping blade in contact with the surface material being removed, and which contains a head assembly that prevents the build-up of dust and particle debris between the cutting blade and the cutting blade clamp. This prevention of dust and particle debris build-up prolongs the life of the tool. The tool design allows the individual user to apply an impact load to the surface material from an upright position without the necessity of pulling back the entire tool which not only requires less effort but also promotes cleaner operation.

The present invention is directed to an improved impact scraping tool composed of a ramming member which utilizes an elongated handle that is gripped by the operator for applying external thrust force to the ramming member in an axial direction. A thrust member, slidably mounted to the ramming member, telescopically engages the ramming member throughout the operation of the tool. To transfer the momentum of the ramming member to the thrust member, the ramming member has an abrupt change in cross-section which prevents continued axial movement of the ramming member during a thrust movement. The momentum of the ramming member is transferred to the thrust member when the ramming member engages the cross-section barrier. A blade support plate which has a lateral groove in each of its opposing planar surfaces is clamped by a pair of T-shaped clamp members each having a laterally extending shoulder adapted for insertion into the grooves. By clamping the blade support member through the use of a shoulder and groove, material removed from a surface is prevented from forming a build-up between the support member and the clamp.

The blade support plate has a recessed region located on its periphery which acts as a bearing surface for a spacer plate which is positioned between the T-shaped clamp members and bears against the periphery of the blade support plate in the recessed region. Riveting of the T-shaped clamp members to the blade support plate causes the shoulders of the clamp members to engage the grooves of the base support plate and thereby form a barrier to the build-up of material. The spacer plate is rigidly positioned into assembly with the clamp members and the blade support plate during the riveting operation. This head assembly prolongs the life of the tool by eliminating the forces exerted on the rivets by the wedging of surface material between the clamped surfaces and also prolongs the life of the tool by decreasing the shear forces acting on the rivets in the head assembly.

A cutting blade is removeably mounted to the blade support plate by conventional fastening means. By removably mounting the cutting blade to the blade support plate, material build-up between the plate and blade is easily removed for decontamination or for reducing the stress in the conventional fasteners holding these members together.

As can be appreciated, the impact scraping tool according to the present invention is inexpensive to manufacture, allows the user to stand upright when removing materials from a surface, permits the user to constantly keep the scraping blade in contact with the surface being removed thus keeping dust to a minimum, and has prolonged life by substantially reducing material build-up between the blade support plate and the clamp members.

BRIEF DESCRIPTION OF THE DRAWINGS

These and other features and advantages will become appreciated as the same become better understood with reference to the following specification, claims and drawings wherein:

FIG. 1 is a exploded perspective view of the impact scraping tool according to the present invention;

DETAILED DESCRIPTION

Referring to FIG. 1, an exploded perspective view is shown of the impact scraping tool. Ramming member 1 has a longitudinal axis 2 and as shown in the illustration ramming member 1 has a handle section 3 which is a hollow tubular member prefereably made from a metallic material which is welded to the impact section 5 of the ramming member. Impact section 5 is made of a metallic material and has an axially extending rectangular passage 7 which in conjunction with tubular member 3 forms a continuous structure having a discontinuity in cross-section which forms a barrier 4 to the axial movement of thrust member 6. Thrust member 6 is also made of metallic material and has an axially extending rectangular cross-section and inserts into the axially extending rectangular passage 7 of impact section 5. As shown in FIG. 1, thrust member 6 has a rectangular internal cavity 8 which extends axially throughout the length of thrust member 6. In another embodiment, the ramming member may be a continuous tube where the discontinuity of cross-section results from crimping the ramming member to form the barrier.

As illustrated in FIG. 1, thrust member 6 contains an axially extending slot 8 located in sidewall 9 of the thrust member. The thrust member is captively held by the impact section 5 of the ramming member 1 by utilizing a screw key 10 which inserts through slot 8 thereby preventing a disassociation of the ramming member and the thrust member during reciprocation action of the ramming member in operation of the tool.

In further describing thrust member 6, it can be seen at the impact end 11 of said member, that the member contains two aperatures 12 and 13 in top wall 14. Similarly, and symmetrically located on the bottom wall 15 of thrust member 6, are aperatures of the same diameter as aperatures 12 and 13 and coaxially aligned therewith. As shown in the FIG. 1, rivets 16, 17, 26 and 27 fasten together the improved head of the cutting tool which consists of blade support plate 23, a pair of T-shaped clamps 18 and 19, and a spacer plate 20. The T-shaped clamps and the spacer plate have aperatures in their surfaces which are aligned vertically after the assembly of these sections is inserted into the impact end 11 of thrust member 6 and thereafter securely assembled and fastened together by the setting of rivets 16 and 17.

T-shaped clamp members 18 and 19 have laterally extending shoulders 21 and 22 which insert into lateral grooves contained in the surface of blade support plate 23. The under surface 25 of blade support plate 23 is symmetrical to the upper surface 25 of blade support plate 23. The groove 24 in the upper surface of blade support plate 23 laterally extends in part across the upper surface; similarly on the under surface, a groove laterally extends in part across the under surface (not shown in the drawing, but is identical in location and symmetrically serves the same purpose as groove 24). In attaching the bottom support plate 23 to T-shaped clamps 18 and 19 the laterally extending shoulders 21 and 22 of the T-shaped clamps insert into the grooves located in the upper and under surfaces of the blade support plate. The extension of the shoulders of the T-shaped clamps into the grooves of the blade support plate prevent material which is scraped from a floor surface from wedging between the clamp and the plate. Thus, the present invention prevents material such as dust and floor covering particles from building up and causing high stresses to act upon the rivets 26 and 27 which fasten the bottom plate to the T-shaped clamps through aperatures 28 and 29 in blade support plate 23.

Located on the periphery of blade support plate 23 is a recess section 30 against which spacer plate 20 bears. The purpose of the spacer plate 20 and the recess 30 is to limit the bearing stress in aperatures 12 and 13 and the sheer stress in rivets 16 and 17 during operation of the tool.

A cutting blade 31 is removeably mounted to blade support plate 23 by conventional bolts 32 and 33 with standard type nuts 36 and 37. The bolts extend through blade 31 and blade support member 23 as shown in FIG. 1. A pair of stops 34 and 35 extend from the upper surface of blade support member 23 and serve to align the openings 38 and 39 in the cutting blade with the holes 40 and 41 in the blade support plate 23. The stops 34 and 35 also absorb the forces of impact of blade 31 against material which is being removed from a floor surface.

In operation, the cutting blade 31 is placed contiguous to the material which is to be removed and ramming member 1 is axially retracted relative to thrust member 6 until it reaches the limit of travel of slot 8. At this limit the operator of the tool thrusts the ramming member forward by the application of external forces and the ramming member will accelerate until abruptly stopped by the barrier at the cross-section barrier 4 of impact section 5 and the handle 3 of the ramming member. The momentum of the ramming member is then transferred to the head assembly of the scraping tool which translates into dynamic forces acting through the cutting blade into the material surface to be removed. Dust and material particles are precluded from building up between the T-shaped clamps and the surfaces of the blade support plate which results in less stress acting upon rivets 16 and 17 thus resulting in longer life of the head assembly.

While I have shown a preferred embodiment of the present invention, it is to be understood that it is subject to many modifications without departing from the scope and spirit of the claims as recited herein.

What is claimed is:

1. An improved impact scraping tool for scraping material from surfaces, comprising:

(a) A ramming member having a longitudinal axis for transmitting thrust faces externally applied to said ramming member to said surface;

(b) A thrust member telescopically mounted to said ramming member to permit slidable axial movement relative thereto;

(c) Barrier means carried by said ramming member for barring further axial movement of said ramming member relative to said thrust member such that the momentum of said ramming member is transferred to said thrust member upon said thrust member engaging said barrier means;

(d) a blade support plate carried by said thrust member having a laterally extending groove in its upper and under surfaces;

(e) A pair of clamp members having a laterally extending shoulder adapted for insertion into said lateral grooves where said clamp members are mounted to said thrust member; and (f) A cutting blade removably mounted to said blade support plate such that upon application of an external thrust force to said ramming member said thrust member will engage said barrier means where upon the momentum of said ramming member is transferred to said thrust member thereby permitting said cutting blade to impact against said material surface.

2. The improved impact scraping tool recited in claim 1 further comprising a spacer plate positioned intermediate said clamp members and bearing in part against said blade support plate.

3. The improved impact scraping tool recited in claim 2 where said blade support plate has a recess region contiguous with said spacer plate.

4. The improved impact scraping tool recited in claim 3 wherein said barrier means comprises a discontinuity in cross-section of said ramming member.

5. An improved impact tool for scraping material from surfaces of the type having a cutting blade, a ramming member having a longitudinal axis for transmitting thrust forces externally applied to said ramming member, a thrust member telescopically mounted to said ramming member for slidable relative axial movement therewith, barrier means responsive to relative axial movement between said ramming member and said thrust member for stopping said relative axial movement, wherein the improvement comprises:

(a) A blade support plate carried by said thrust member having a laterally extending groove contained in its upper and under surfaces; and (b) A pair of clamp members oppositely mounted to said thrust member and having a laterally extending shoulder adapted for insertion into said lateral grooves where said clamp members are mounted to said thrust member such that material scraped from said surfaces is precluded from build-up between said clamp members and said blade support plate.

6. The improved impact scraping tool recited in claim 5 further comprising a spacer plate positioned intermediate said clamp members and bearing in part against said blade support plate.

7. The improved impact scraping tool recited in claim 6 where said blade support plate has a recess region contiguous with said spacer plate.

8. The improved impact scraping tool recited in claim 7 where said barrier means comprises a discontinuity in cross-section of said ramming member.

* * * * *

UNITED STATES PATENT AND TRADEMARK OFFICE
CERTIFICATE OF CORRECTION

PATENT NO. : 5,010,647

DATED : April 30, 1991

INVENTOR(S) : Thomas C. Gray

It is certified that error appears in the above-identified patent and that said Letters Patent is hereby corrected as shown below:

The title page, should be deleted to be replaced with the attached title page.

The drawing sheet should be deleted to be replaced with the attached drawing sheet.

Signed and Sealed this

Twenty-second Day of June, 1993

*Attest:*

Michael K. Kirk

MICHAEL K. KIRK

*Attesting Officer*

*Acting Commissioner of Patents and Trademarks*

United States Patent [19]

Gray

[11] Patent Number: 5,010,647

[45] Date of Patent: Apr. 30, 1991

[54] IMPACT SCRAPING TOOL FOR SCRAPING MATERIAL FROM SURFACES

[76] Inventor: Thomas C. Gray, 683 N. Fox, Flagstaff, Ariz. 86001

[21] Appl. No.: 385,284

[22] Filed: Jul. 25, 1989

[51] Int. Cl.[5] ..... B26B 3/00

[52] U.S. Cl. ..... 30/169; 173/90; 15/236.01

[58] Field of Search ..... 173/90, 128; 15/236.01; 30/169, 172

[56] References Cited

U.S. PATENT DOCUMENTS

| | | | |
|---|---|---|---|
| 1,710,113 | 4/1929 | Rothermel | 15/236.01 X |
| 2,105,960 | 1/1938 | Wolfe | 15/236.01 X |
| 2,359,408 | 10/1944 | Disse | 15/236.01 X |
| 4,381,604 | 5/1983 | Horst | 15/236.01 X |
| 4,624,323 | 11/1986 | Burrola | 173/90 |
| 4,779,301 | 10/1988 | Millette | 15/236.01 |

*Primary Examiner*—Paul A. Bell

*Assistant Examiner*—Willmon Fridie, Jr.

*Attorney, Agent, or Firm*—Frederick Gotha

[57] ABSTRACT

An improved impact scraping tool for scraping material from surfaces is set forth having a ramming member for transmitting externally applied thrust forces to a thrust member which is slidably mounted to the ramming member for relative motion therewith. The ramming member has a discontinuity in cross-section which when engaged by the thrust member stops the relative motion between the members and results in a transfer of the momentum of the ramming member to the thrust member. A blade support plate having lateral grooves in its upper and under surfaces is carried by the thrust member and clamped to a pair of T-shaped claims which have laterally extending shoulders for engagement into the grooves. Material scraped from surfaces is precluded from wedging between the clamps and the blade support plate which prolongs the life of the scraping tool.

8 Claims, 1 Drawing Sheet

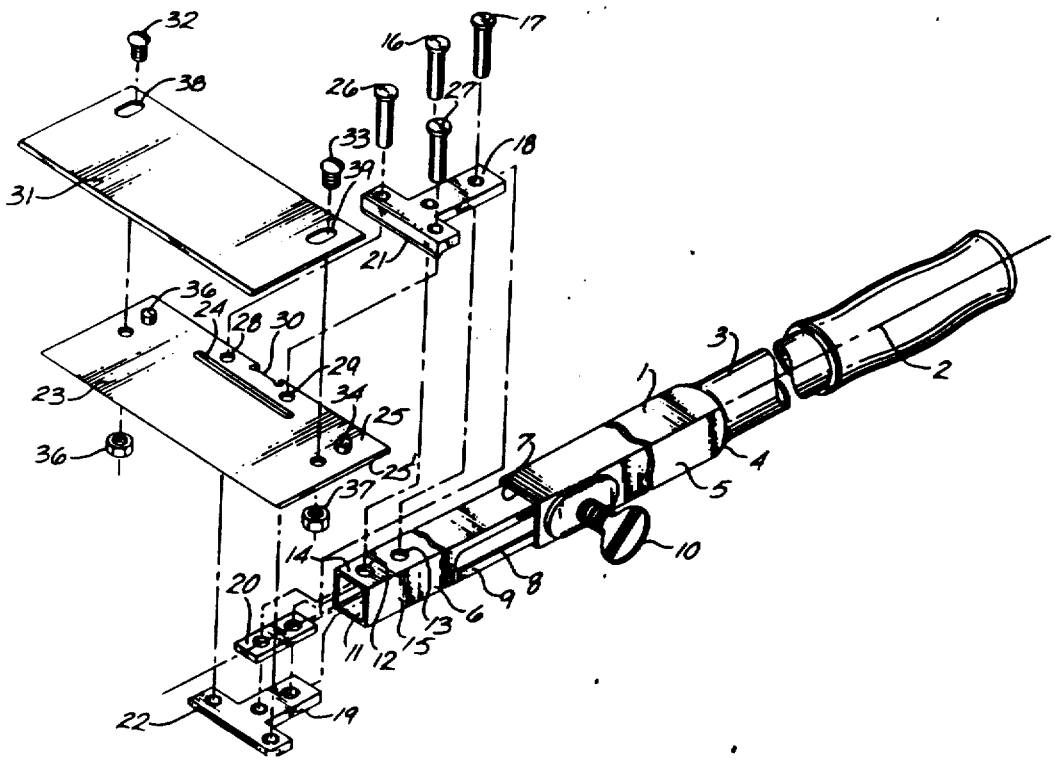

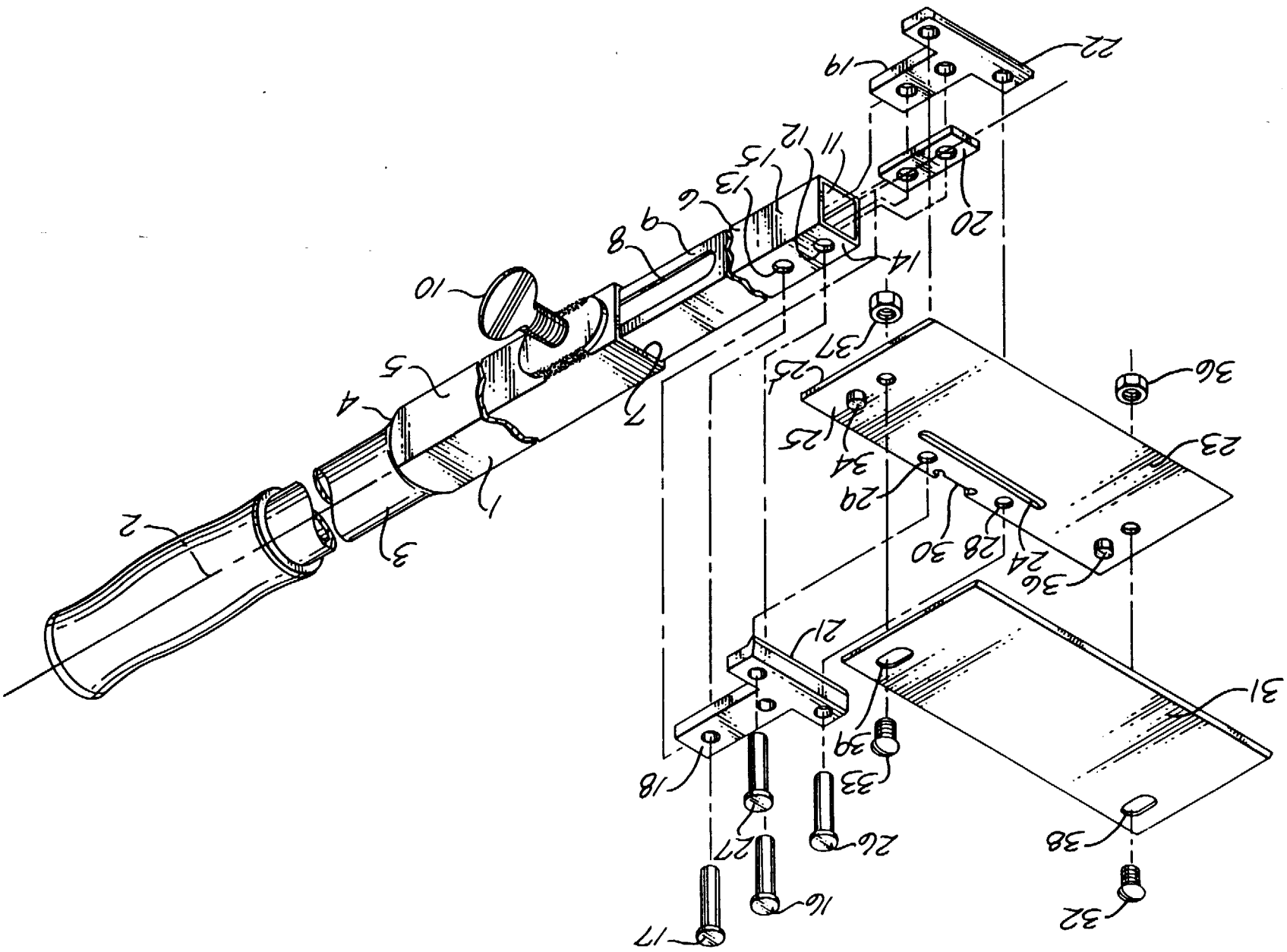
1
2
3
4
5
6
7
8
9
10
11
12
13
14
15
16
17
18
19
20
21
22
23
24
25
26
27
28
29
30
31
32
33
34
35
36
37
38
39